US008512069B2

(12) United States Patent
Kao et al.

(10) Patent No.: US 8,512,069 B2
(45) Date of Patent: Aug. 20, 2013

(54) FLAT PLUG ELECTRICAL CONNECTOR

(75) Inventors: Selvin Kao, Ladera Ranch, CA (US); Philip Carlo J. DeGuzman, Fontana, CA (US)

(73) Assignee: Standard Cable USA, Inc., Rancho Santa Margarita, CA (US)

( * ) Notice: Subject to any disclaimer, the term of this patent is extended or adjusted under 35 U.S.C. 154(b) by 154 days.

(21) Appl. No.: 13/182,320

(22) Filed: Jul. 13, 2011

(65) Prior Publication Data

US 2013/0017714 A1 Jan. 17, 2013

(51) Int. Cl.
*H01R 13/58* (2006.01)

(52) U.S. Cl.
USPC ..... 439/465; 439/106; 439/696

(58) Field of Classification Search
USPC ..... 439/465–467, 696, 106
See application file for complete search history.

(56) References Cited

U.S. PATENT DOCUMENTS

| | | | | |
|---|---|---|---|---|
| 3,335,394 | A * | 8/1967 | Miller | 439/465 |
| 3,573,714 | A * | 4/1971 | Turner | 439/465 |
| 4,026,618 | A | 5/1977 | Straka | |
| 5,315,062 | A * | 5/1994 | Hoshino | 439/446 |
| D354,941 | S | 1/1995 | Lentz et al. | |
| 5,399,093 | A | 3/1995 | Schneider et al. | |
| 5,567,181 | A | 10/1996 | Lentz et al. | |
| 6,074,238 | A * | 6/2000 | DeRoss et al. | 439/409 |
| 6,454,612 | B1 * | 9/2002 | Wang | 439/694 |
| 7,063,558 | B1 | 6/2006 | Chen | |
| 7,140,905 | B2 * | 11/2006 | Castaldo | 439/410 |
| 2013/0017714 | A1 * | 1/2013 | Kao et al. | 439/460 |

* cited by examiner

*Primary Examiner* — James Harvey
(74) *Attorney, Agent, or Firm* — Vic Y. Lin; Innovation Capital Law Group, LLP

(57) ABSTRACT

A low-profile flat plug electrical connector having an integrated strain relief section and an interlocking terminating end is disclosed. The flat plug electrical connector has a housing for holding the electrical cable and prongs, and a cap for covering the internal structure of the housing. The housing has an integrated strain relief section for preventing damage to the flat plug electrical connector from abrupt pulling or pushing of the electrical cords. The cap and the housing have interlocking terminating ends which are configured for preventing the cap from separating from the housing when the plug is pulled from an electrical outlet. The electrical prongs of the hot and neutral electrical wires and the ground pin are locked in place by posts protruding from the cap which urges the prong mounting tab against a mounting surface in the housing.

21 Claims, 9 Drawing Sheets

FLAT PLUG ELECTRICAL CONNECTOR

BACKGROUND OF THE INVENTION

1. Field of the Invention

The present invention relates in general to electrical connectors. More particularly, the invention is directed to flat plug electrical connectors.

2. Description of the Related Art

Flat plug electrical connectors are used in applications in which clearances surrounding electrical outlets prevent the use of conventional straight electrical plugs. However, many flat plug electrical connectors may be damaged if electrical cords are abruptly pulled or if users improperly remove the flat plug electrical connectors from the electrical outlets.

Accordingly, a need exists to improve flat plug electrical connectors.

SUMMARY OF THE INVENTION

In the first aspect, an electrical plug comprising a housing, at least two electrical contact members, an electrical cord, and a cap is provided. The housing comprises a front mating end having a at least two through-holes oriented in a first direction and an integrated strain relief section extending from the front mating end in a second direction substantially perpendicular to the first direction. The at least two electrical contact members are each placed in a corresponding through-hole. The electrical cord has at least two electrical wires connected to the electrical contact members. The cap is configured for mating with the housing and substantially encloses the electrical cord and the electrical contact members.

In a first preferred embodiment of the electrical plug, the integrated strain relief section has a plurality of internal ribs protruding inward from sides of the housing to the electrical cord, where the internal ribs are configured for engaging the electrical cord. The plurality of internal ribs preferably protrude inward and toward the front mating end protrudes at an angle with respect to the normal of the sides of the housing. The integrated strain relief section preferably has crimp members projecting in a direction opposite the first direction, where the crimp members are configured for engaging one of the at least two electrical wires. The cap preferably has at least one protruding ridge for engaging the electrical cord. The thickness of the assembled cap and housing is preferably 11.8 millimeters or less.

In a second aspect, the electrical plug comprises a housing, at least two electrical contact members, an electrical cord, and a cap. The housing has a front mating end having a at least two through-holes oriented in a first direction and a housing terminating end extending from the front mating end in a second direction substantially perpendicular to the first direction. At least two electrical contact members each placed in a corresponding through-hole. The electrical cord has at least two electrical wires connected to the electrical contact members. The cap is configured for mating with the housing and substantially encloses the electrical cord and the electrical contact members, where the cap further comprises a cap front mating end and a cap terminating end configured for engaging the housing terminating end.

In a second preferred embodiment, the housing terminating end has a housing U-shaped member having arms extending outward parallel with a third direction perpendicular to the first and second directions. The cap terminating end preferably has a cap U-shaped member having recesses extending outward parallel with the third direction, wherein the cap terminating end is configured for engaging the housing terminating end when the cap is assembled onto the housing. The housing preferably has an inner shoulder that is configured for receiving the cap such that an upper surface of the cap is flush with the housing. The front mating end preferably has a plurality of walls offset from and partially surrounding each of the through-holes to form mounting surfaces adjacent to the through-holes. Each of the electrical contact members preferably has a male connector placed in the through-hole, a terminal for electrically connecting to the electrical wires, and an electrical contact member tab perpendicular with the male connector configured for mounting on the mounting surface adjacent to the through holes. The cap preferably has at least two posts each configured for securing the electrical contact member tab against the mounting surface. Each of the male connectors preferably has an electrical prong configured for receiving electricity from an electrical outlet. The cap is preferably ultrasonically welded to the housing.

The housing preferably has a recessed section on the outer surface of the housing. The recessed section preferably has a protruding ridge extending outward from the recessed section. The cap preferably has a protruding tab having an aperture. The cap is preferably secured to the housing by the protruding tab engaging with the protruding ridge of the housing. The thickness of the assembled cap and housing is preferably 11.8 millimeters or less.

In a third aspect, the electrical plug comprises a housing, an electrical cord, a first and second pronged electrical contact member, a male ground pin, and a cap. The housing has a front mating end having a first and second rectangular through-hole slots and a round through-hole oriented in a first direction, an integrated strain relief section extending from the front mating end in a second direction substantially perpendicular to the first direction, and a housing terminating end extending from the strain relief section in the second direction. An electrical cord has an outer sheath surrounding a hot wire, a neutral wire, and a ground wire. A first pronged electrical contact member is placed in the first rectangular through-hole slot and electrically coupled to the hot wire. A second pronged electrical contact member is placed in the second rectangular through-hole slot and electrically coupled to the neutral wire. A male ground pin is placed in the round through-hole and electrically coupled to the ground wire. A cap is configured for mating with the housing and substantially enclosing the electrical cord and the electrical contact members, where the cap further comprises a cap front mating end, a cap strain relief section, and a cap terminating end configured for engaging the housing terminating end when the cap is assembled onto the housing.

In a third preferred embodiment, the housing terminating end further comprises a housing U-shaped member having arms extending outward parallel with a third direction perpendicular to the first and second directions. The cap terminating end preferably has a cap U-shaped member and recesses extending outward parallel with the third direction, wherein the cap terminating end is configured for engaging the housing terminating end when the cap is assembled onto the housing. The strain relief section preferably has a plurality of internal ribs protruding inward and toward the front mating end forming an angle with respect to the normal of the sides of the housing, where the internal ribs are configured for engaging the electrical cord. The strain relief section preferably has crimp members projecting in a direction opposite the first direction, wherein the crimp members are configured for engaging the ground wire.

The front mating end preferably has a plurality of walls offset from and partially surrounding each of two rectangular through-hole slots and the round through-hole to form mounting surfaces adjacent to the two rectangular through-hole slots and the round through-hole. The first pronged electrical contact member preferably has a first terminal for electrically connecting to the hot wire. A first tab perpendicular with the first pronged electrical contact member preferably configured for mounting on the mounting surface adjacent to the first rectangular through-holes slot. The second pronged electrical contact member preferably has a second terminal for electrically connecting to the neutral wire and a second tab perpendicular with the second pronged electrical contact member configured for mounting on the mounting surface adjacent to the second rectangular through-holes slot. The male ground pin preferably has a ground pin member tab perpendicular with the male ground pin configured for mounting on the mounting surface adjacent to the round through-hole. The cap preferably has a first post for urging the first tab against the mounting surface adjacent to the first rectangular through-holes slot, a second post for urging the second tab against the mounting surface adjacent to the second rectangular through-holes slot, and a third post for urging the ground pin member tab against the mounting surface adjacent to the round through-hole. The cap is preferably ultrasonically welded to the housing.

The housing preferably has a recessed section on the outer surface of the housing, the recessed section has a protruding ridge extending outward from the surface of the side of the housing. The cap preferably has a protruding tab having an aperture. The cap is preferably secured to the housing by the protruding tab engaging with the protruding ridge of the housing. The thickness of the assembled cap and housing is preferably 11.8 millimeters or less.

These and other features and advantages of the invention will become more apparent with a description of preferred embodiments in reference to the associated drawings.

DETAILED DESCRIPTION OF THE PREFERRED EMBODIMENTS

The following preferred embodiments are directed to low-profile, flat plug electrical connectors. Flat plug electrical connectors have electrical prongs and pins which are perpendicular with respect to the electrical cords. This feature enables flat plug electrical connectors to be employed in applications having limited space surrounding electrical outlets. In an embodiment, a flat plug electrical connector has a housing for holding the electrical cable and prongs, and a cap for covering the internal structure of the housing. The housing has an integrated strain relief section which engages the electrical cord to prevent damage to the flat plug electrical connector when the electrical cords are pushed or pulled with excessive force. The cap and the housing have interlocking terminating ends which prevent the cap from separating from the housing when the flat plug electrical connector is separated and pulled away from an electrical outlet. The electrical prongs are securely held in place by posts on the caps urging a tabbed portion of the prongs against a mounting surface on the housing. The cap is ultrasonically welded to the housing to form a hermetic seal.

In another aspect, the cap is attached to the housing by employing tabs on the cap which latch onto the housing. The housing has a recessed portion which has a protruding ridge that extends away from the surface of the housing. The cap has a protruding tab that has an aperture that is configured for receiving the protruding ridge on the housing. The tab on the cap snaps onto the recessed portion of the housing and holds the cap onto the housing.

While the embodiments presented in the description and figures depict non-limiting examples of flat plug electrical connectors suitable for typical 120 volt AC electrical outlet common in the United States, it shall be understood that other embodiments may be adapted for other prong configurations, electrical standards, and voltage and current requirements.

Figure 1A:
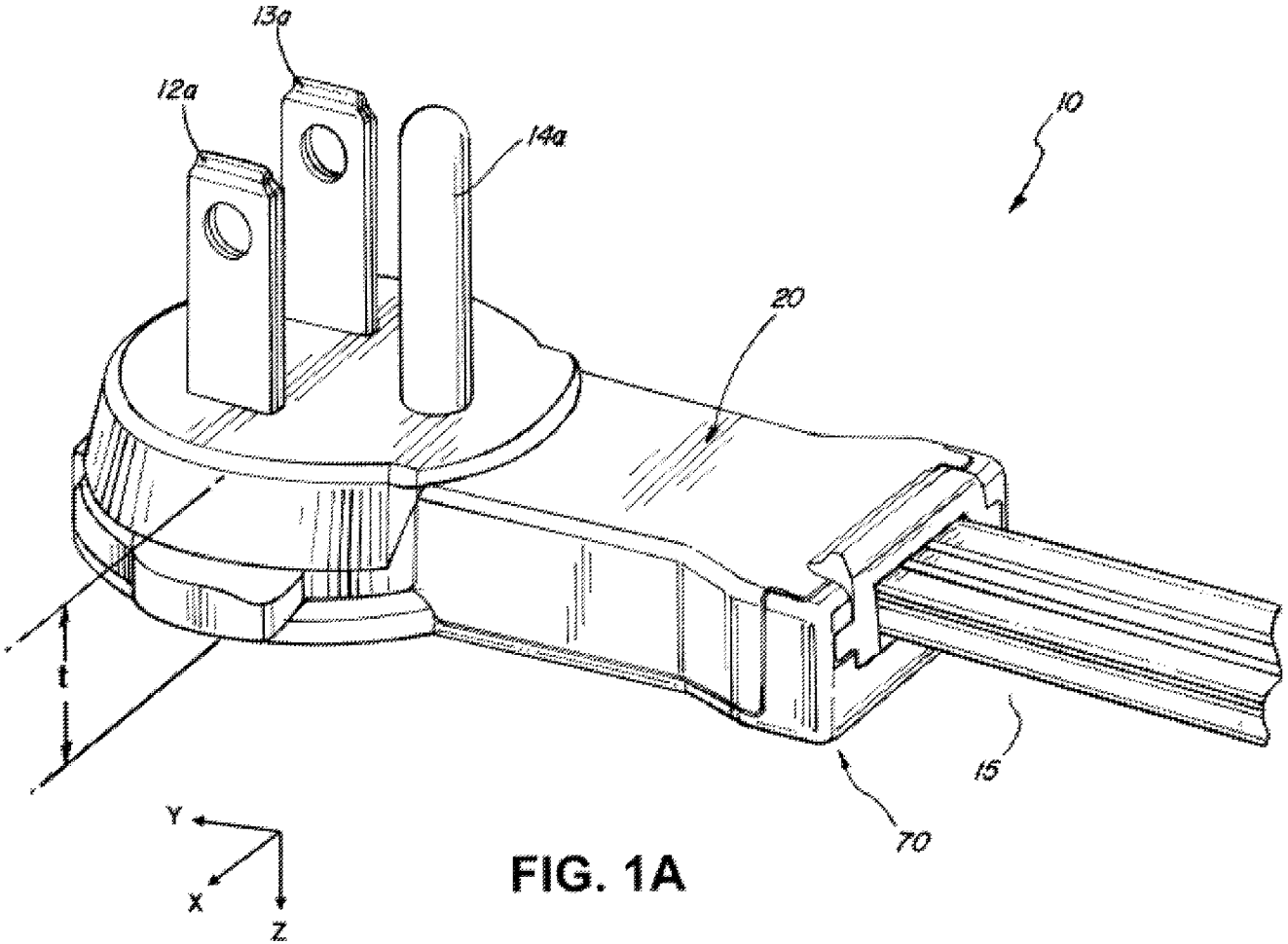
FIG. 1A is a top, assembled, perspective view of a first preferred embodiment of a flat plug electrical connector.
Figure 1B:
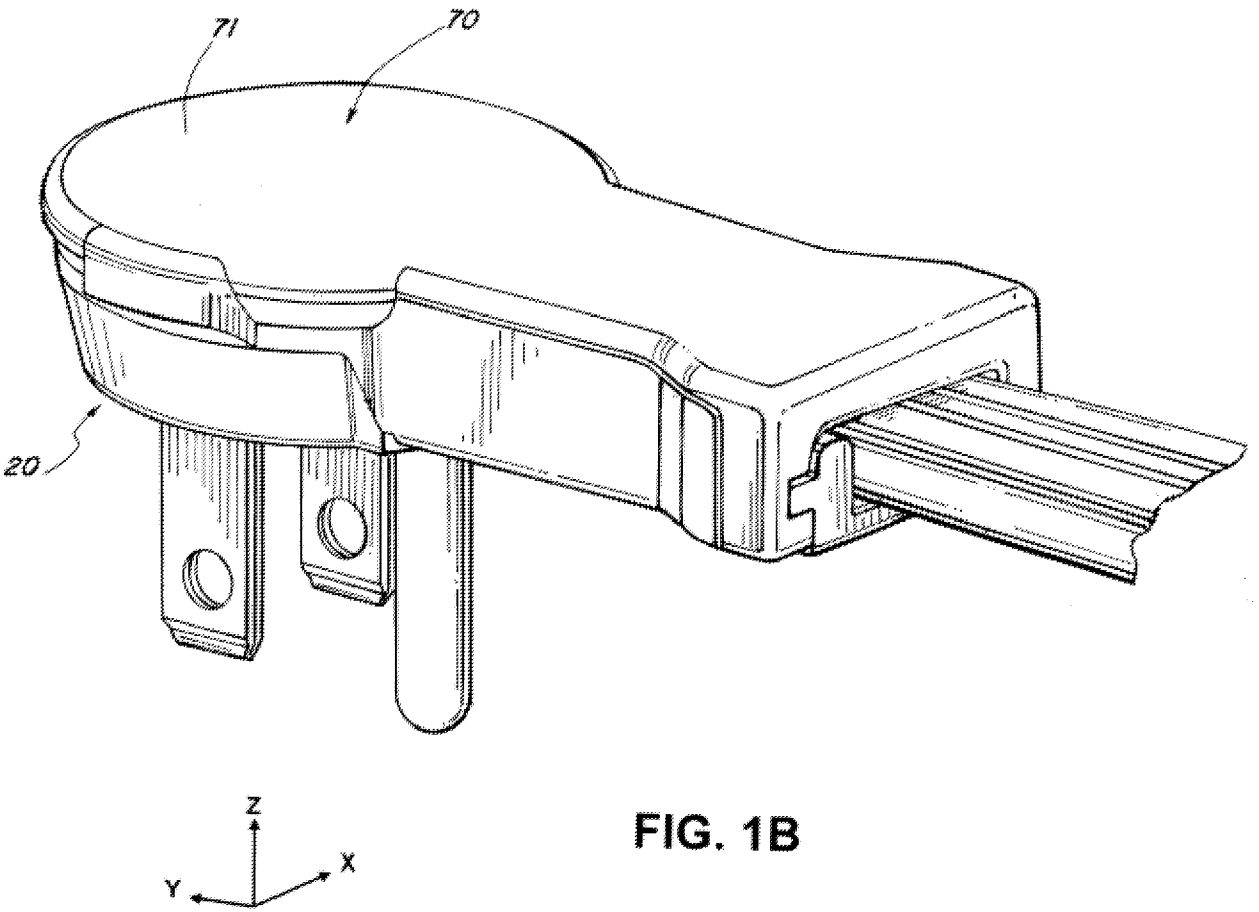
FIG. 1B is a bottom, assembled, perfective view of the first preferred embodiment of the flat plug electrical connector.
Figure 2:
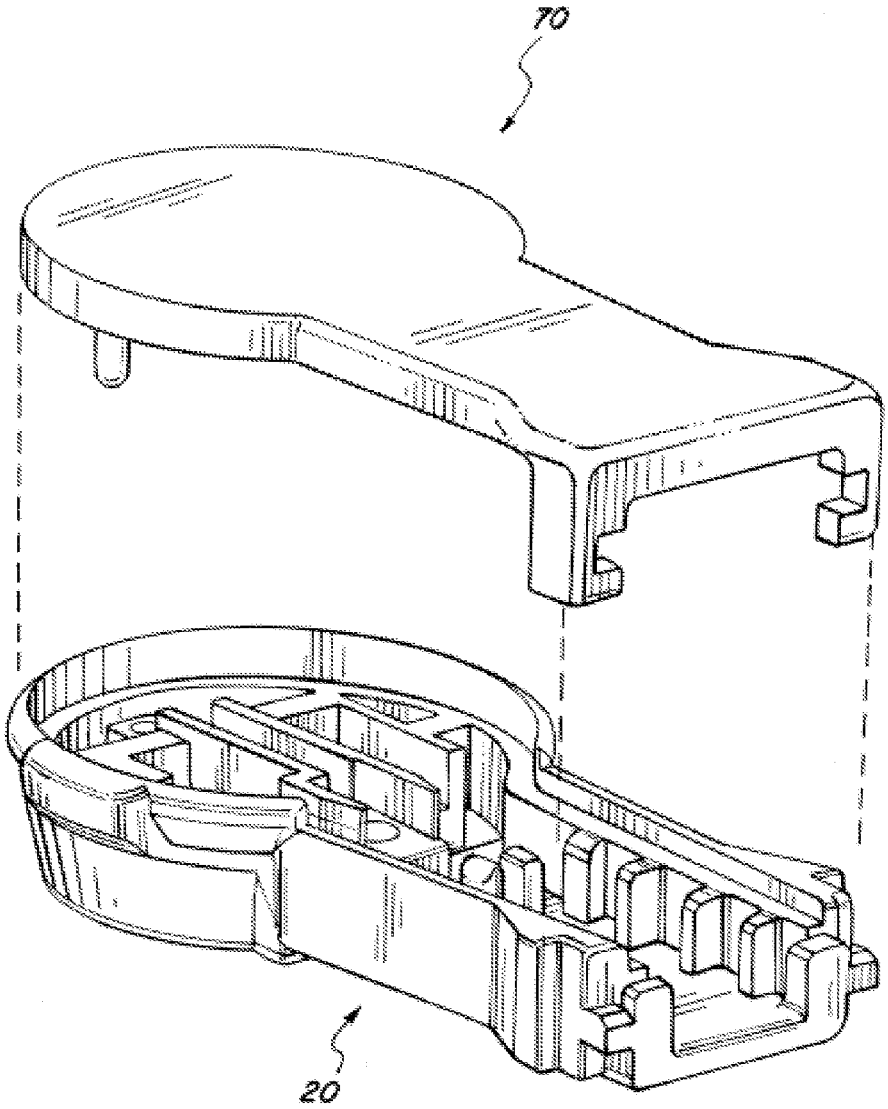
FIG. 2 is an exploded, perspective view of the first preferred embodiment of the flat plug electrical connector showing an exemplary housing and a cap.

FIGS. 1A and 1B are assembled, perspective views of a first preferred embodiment of a flat plug electrical connector 10. The flat plug electrical connector 10 has a housing 20 and a cap 70. As depicted in FIG. 2, the cap 70 and the housing 20 are preferably separate pieces that are designed to attach together to form the flat plug electrical connector 10. The electrical cord 15 having hot, neutral, and ground wires are mounted on the housing 20. The hot prong 12*a* is connected to the hot wire, the neutral prong 13*a* is connected to the neutral wire, and ground pin 14*a* is connected to the ground wire. The thickness of the flat plug electrical connector 10 is roughly the thickness of common electrical cords. In an embodiment, the flat plug electrical connector 10 has a thickness "t" as depicted in FIG. 1 of preferably 12 millimeters or less, such as at 11.8 millimeters or less. This thickness is significantly less than conventional straight plugs which may extend more than an inch from the electrical socket. This thickness is also less than conventional flat plug electrical connectors.

Figure 3:
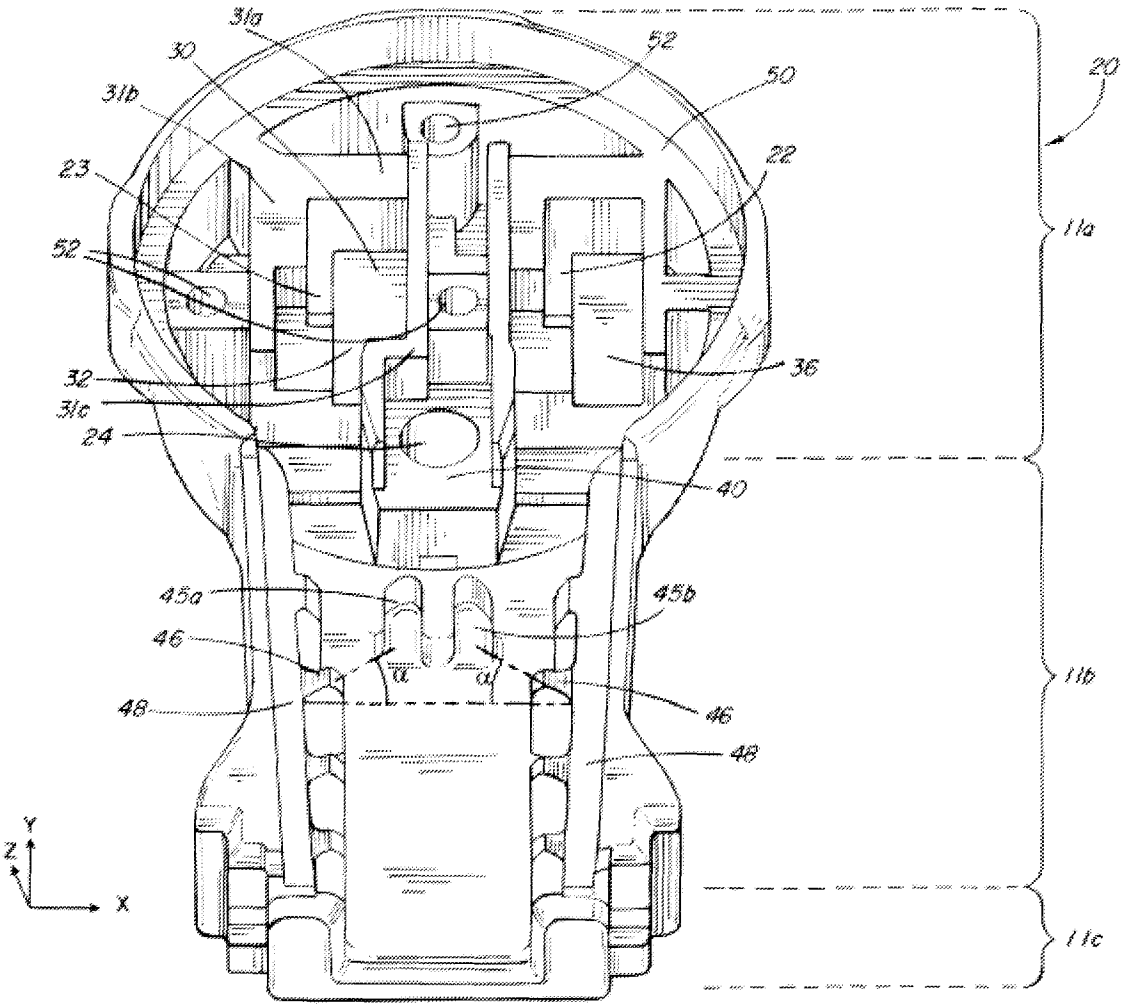
FIG. 3 is a top, perspective view of the inner surfaces of the housing.

FIG. 3 is a top, perspective view of the inner surfaces of the housing 20. The housing 20 has a front mating end 11*a*, an integrated strain relief section 11*b*, and a terminating end 11*c*. The front mating end 11*a*, the integrated strain relief section 11*b*, and the terminating end 11*c* may be formed in a single dielectric plastic piece employing an injection molding process for example.

The front mating end 11*a* has slotted through-holes 22 and 23, and a circular through-hole 24 that are parallel with the z axis in this example. The front mating end 11*a* has a plurality of walls offset from and partially surrounding each of the through-holes to form a mounting surface. For example, walls 31*a*, 31*b*, and 31*c* partially surround the slotted through-hole 23 to form a cavity 30 having a mounting surface 32. Likewise, mounting surface 36 is formed around slotted through-hole 22 and mounting surface 40 is formed surrounding the circular through-hole 24.

Figure 5:
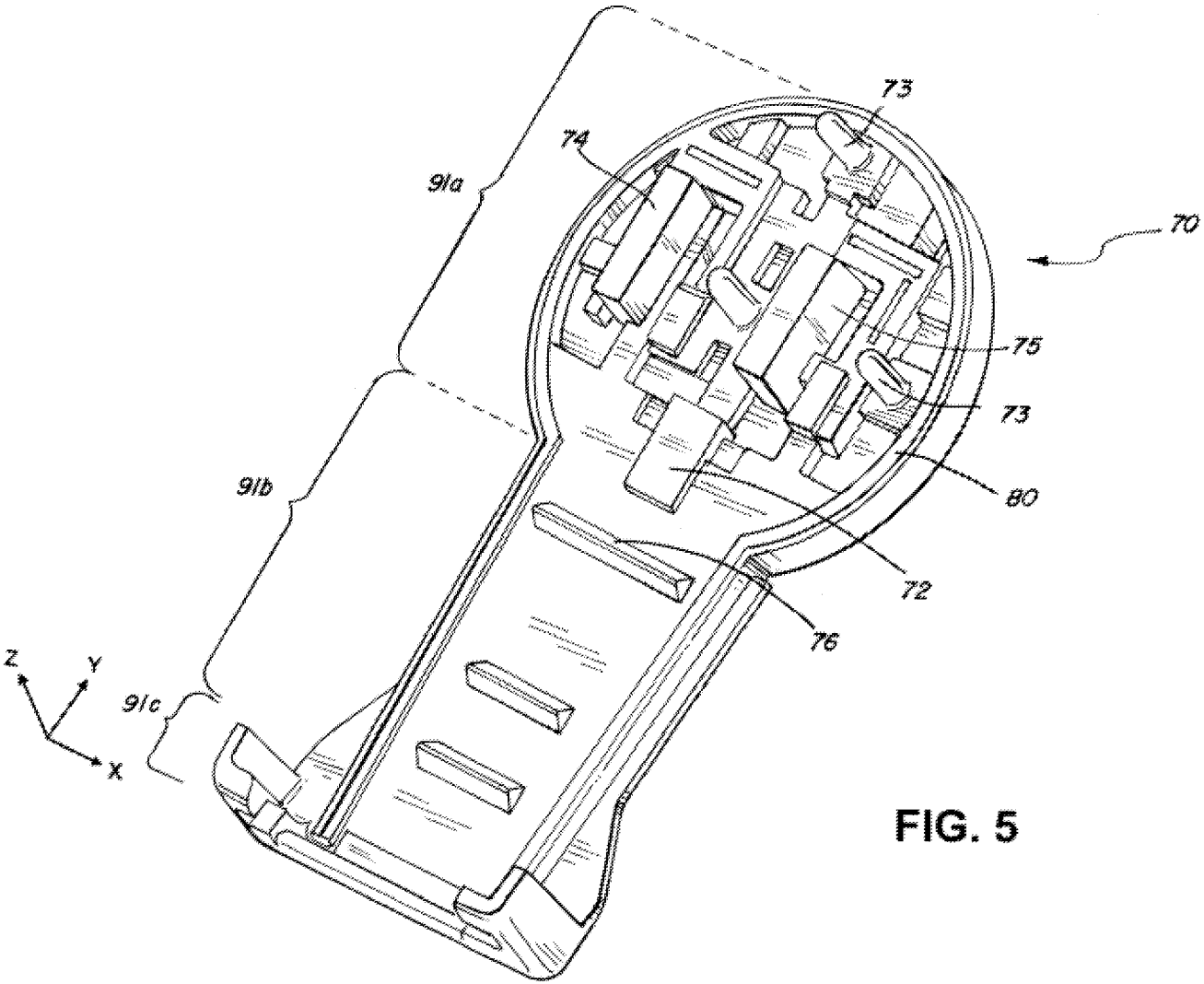
FIG. 5 is a top, perspective view of the inner surfaces of the cap.

The front mating end 11*a* also has a plurality of female mating connectors 52 for aligning with the male mating pins 73 of the cap 70 as depicted in FIG. 5. The front mating end

11*a* has a recessed shoulder 50 which receives the protruding rim 80 of cap 70 such that, when the cap 70 is mated with the housing 20, the cap upper surface 71 is flush with the housing 20 as depicted in FIG. 1B. This feature prevents a user from applying force to the cap 70 that would otherwise separate the cap 70 from the housing 20 when the flat plug electrical connector 10 is removed from an electrical outlet.

The integrated strain relief section 11*b* extends from the front mating end 11*a* parallel with the y axis. The strain relief section has a plurality of internal ribs 46 that protrude inward from the housing sides 48 and engage with the electrical cord 15 to prevent a pull force applied to the electrical cord 15 from being transmitted to the inner electrical connections. As depicted in FIG. 3, the internal ribs 46 are preferably pointed inward and toward the front mating end 11*a* forming an angle a with respect to the normal of housing side 48 to enhance the strain relief.

The integrated strain relief section 11*b* also has crimp members 45*a* and 45*b* which extend in a Z direction. As depicted in FIG. 5, the crimp members 45*a* and 45*b* are employed to engage with the ground wire 18 to enhance the strain relief.

Figure 4:
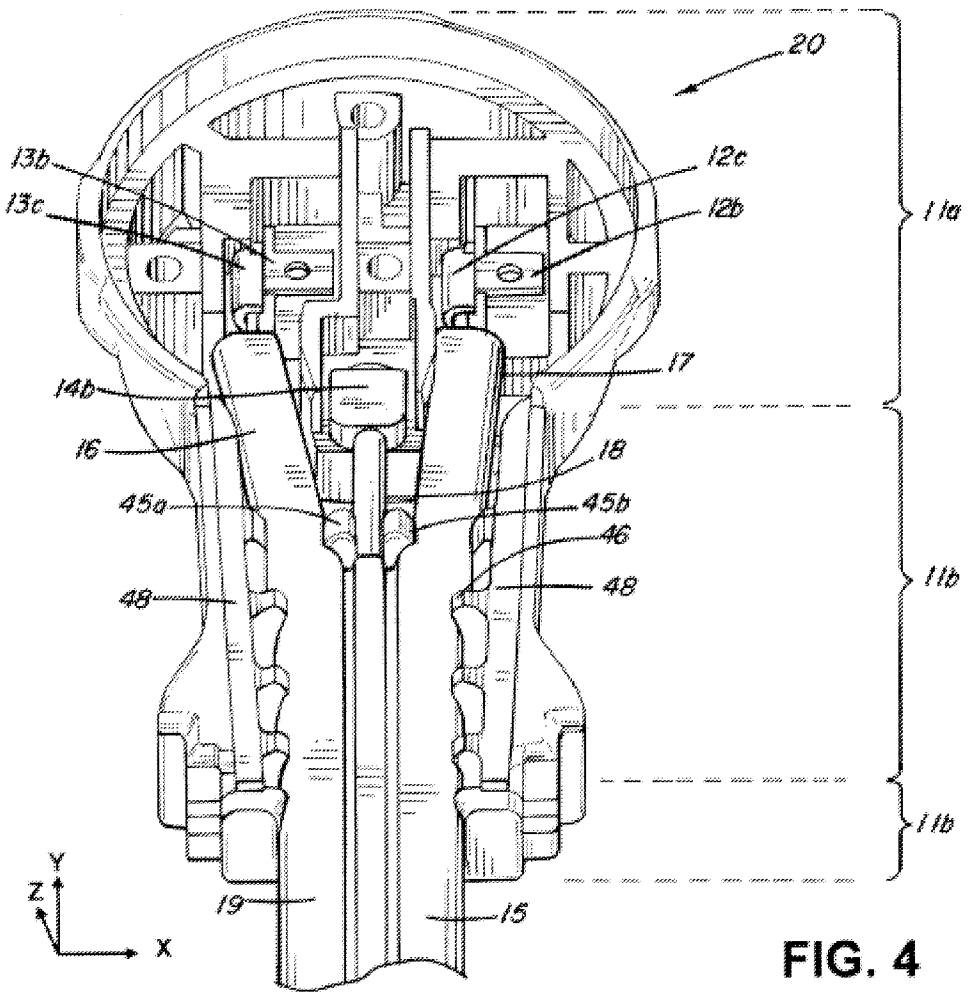
FIG. 4 is a top, perspective view of the housing holding an electrical cord connected to electrical connectors.

FIG. 4 is a top, perspective view of the housing holding an electrical cord connected to the prongs and ground pin. The electrical cord 15 has a neutral wire 16 connected to the neutral return, a hot wire 17 connected to the hot circuit having an electrical potential, and a ground wire 18 connected to ground. The neutral wire 16 is electrically connected to neutral terminal 13*c*. The hot wire 17 is electrically connected to hot terminal 12*c*, and the ground wire 18 is electrically connected to ground wire terminal 14*b*. Terminals 12*c*, 13*c*, and 14*c* are electrically connected to hot prong 12*a*, neutral prong 13*a*, and ground pin 14*a*, respectively. The prongs and terminal pairs 12*a*/12*c* and 13*a*/13*c* each have a corresponding tab 12*b* and 13*b*. The prong, terminal, and tab may be formed in a single metal piece. The neutral prong 13*a* is placed in the slotted through-hole 23, the hot prong 12*a* is placed in the slotted through-hole 22, and the ground pin 14 is placed in the circular through-hole 24. The tabs 12*b* and 13*b* and the ground wire terminal 14*b* are then placed on mounting surfaces 36, 32, and 40 respectively. As discussed below and illustrated in FIG. 5, the posts 74, 75, and 72 of the cap 70 press the tabs 12*b* and 13*b* and the ground wire terminal 14*b* against the mounting surfaces 36, 32, and 40 to ensure prongs 12*a* and 13*a*, and ground pin 14*a* are securely held in place.

Crimp members 45*a* and 45*b* are configured for receiving ground wire 18. FIG. 4 depicts the outer sheathing 19 removed between the crimp members 45*a* and 45*b* and the ground wire terminal 14*b* and the outer sheathing 19 covering the hot wire 17 and neural wire 16 to the terminals 12*c* and 13*c* in this non-limiting example. However, sections of the outer sheathing 19 may be removed in other locations on the wires 16-18.

FIG. 5 is a top, perspective view of the inner surfaces of the cap 70. The cap 70 has a cap front mating end 91*a*, a cap strain relief section 91*b*, and a cap terminating end 91*c*. The cap front mating end 91*a*, the cap strain relief section 91*b*, and the cap terminating end 91*c* may be formed in a single dielectric plastic piece with an injection molding process for example.

The cap front mating end 91*a* has a plurality of male mating pins 73 which are received by the female mating connectors 52 of the housing 70 during the assembly process. The male mating pins 73 and female mating connectors 52 serve to align the cap 70 to the housing 20 during assembly, and provide enhanced mechanical rigidity of the assembled flat plug electrical connector 10. The cap front mating end 91*a* also has posts 74, 75, and 72 for securing tabs 12*b*, 13*b*, and ground wire terminal 14*b* against the mounting surfaces 36, 32, and 40 respectively as discussed above.

The cap strain relief section 91*b* extends from the cap front mating section 91*a* parallel with the y axis in this example. The cap strain relief section 91*b* has one or more protruding ridges 76 which engage with the electrical cord 15 to provide additional strain relief.

Figure 6:
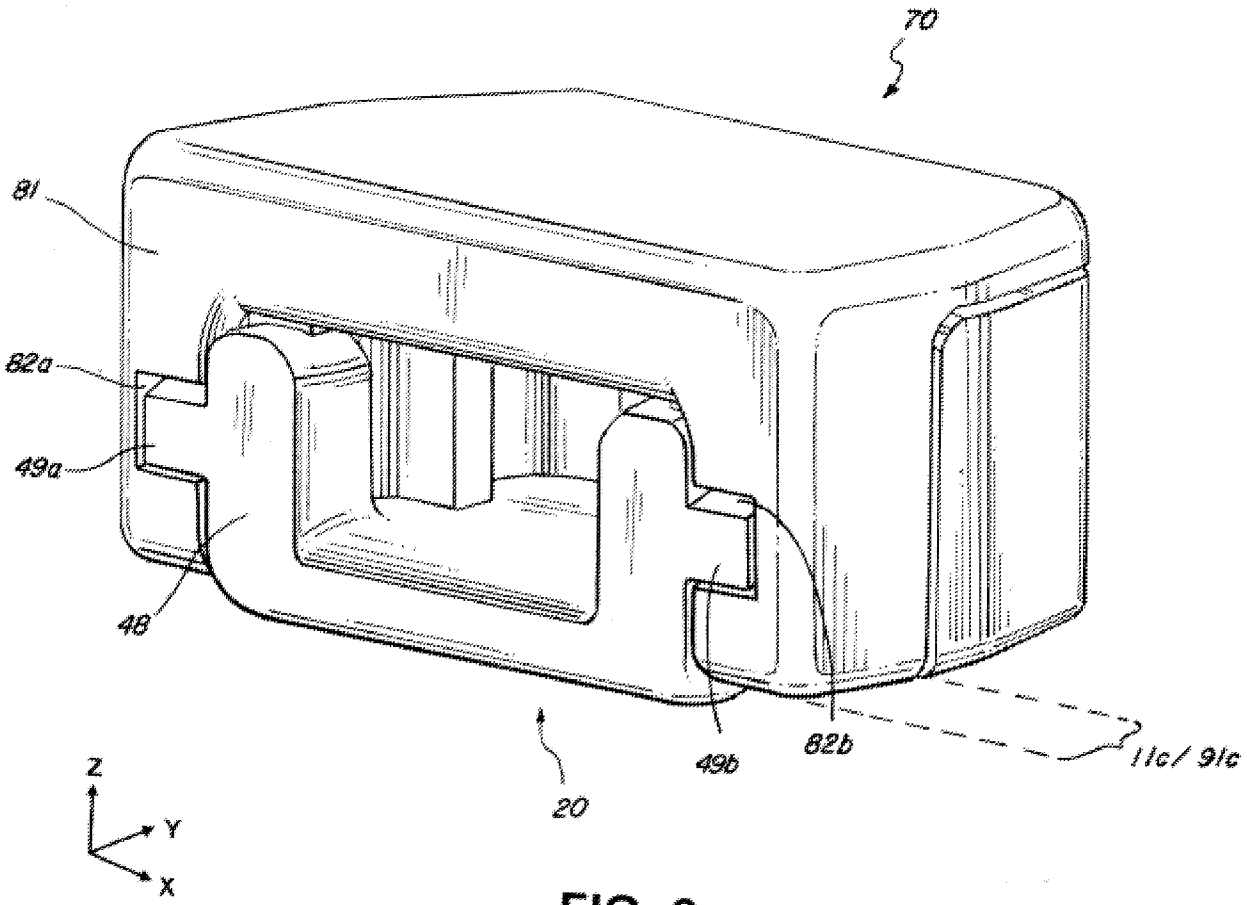
FIG. 6 is a side, perspective view of assembled flat plug electrical connector illustrating the interlocking terminating ends of the housing and cap.

FIG. 6 is a side, perspective view of the assembled flat plug electrical connector 10 illustrating the interlocking terminating ends 11*c* and 91*c*. The housing terminating end 11*c* has a housing U-shaped member 48 having arms 49*a* and 49*b* that extend outward and parallel with the x-axis. The cap terminating end 91*a* has a cap U-shaped member 81 with recesses 82*a* and 82*b* that extend outward and parallel with the x-axis in this example. When assembled, the cap 70 cannot separate from the housing 20 in a direction parallel to the z-axis because the arms 49*a* and 49*b* of the housing U-shaped member 48 are confined within the recesses 82*a* and 82*b* of the cap U-shaped member 48 in this example. This feature prevents the cap 70 from separating from the housing 20 when a user removes the flat plug electrical connector 10 from an electrical outlet.

Figure 7:
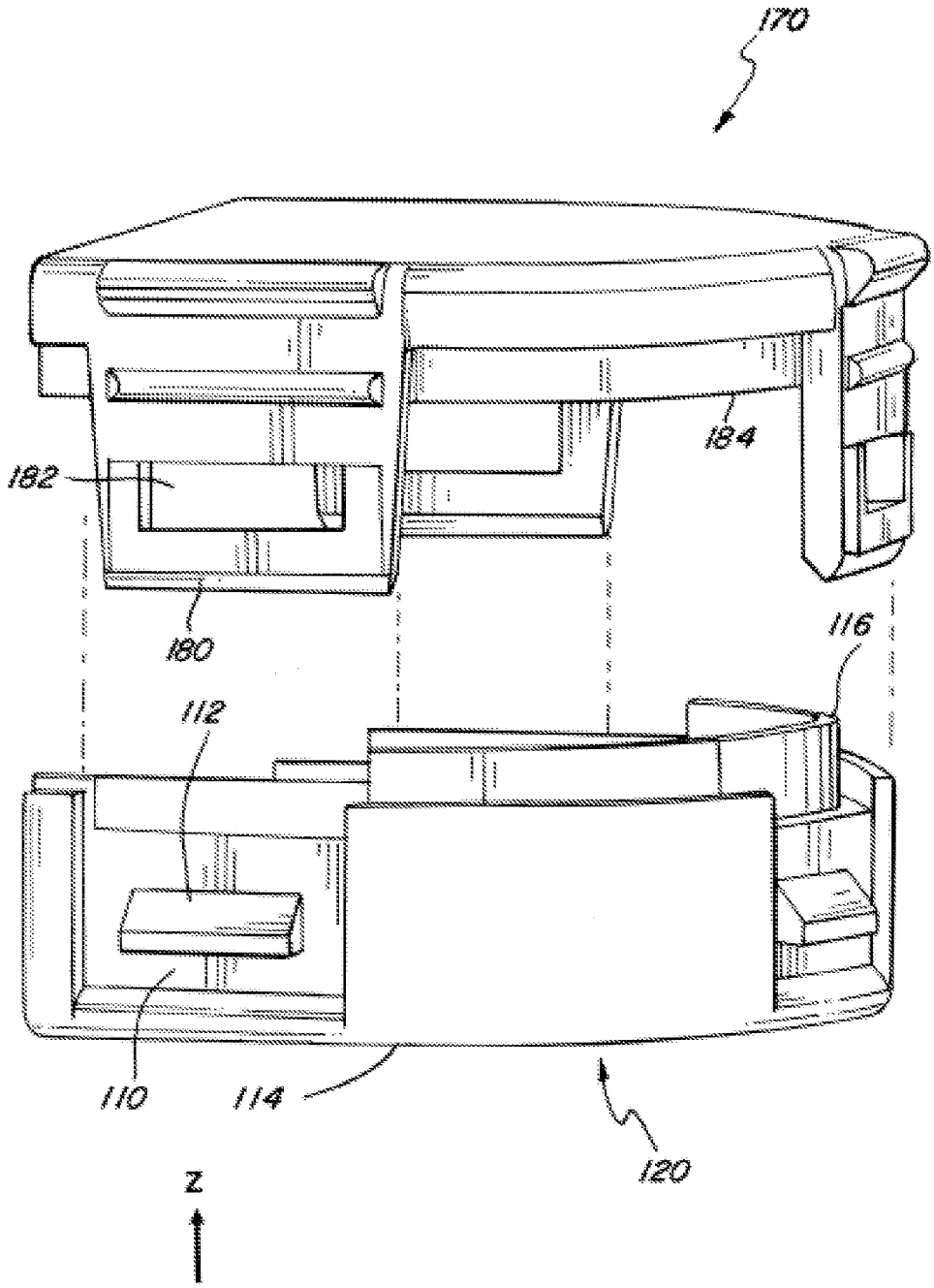
FIG. 7 is an exploded, perspective view of a second preferred embodiment of the flat electrical plug.
Figure 8:
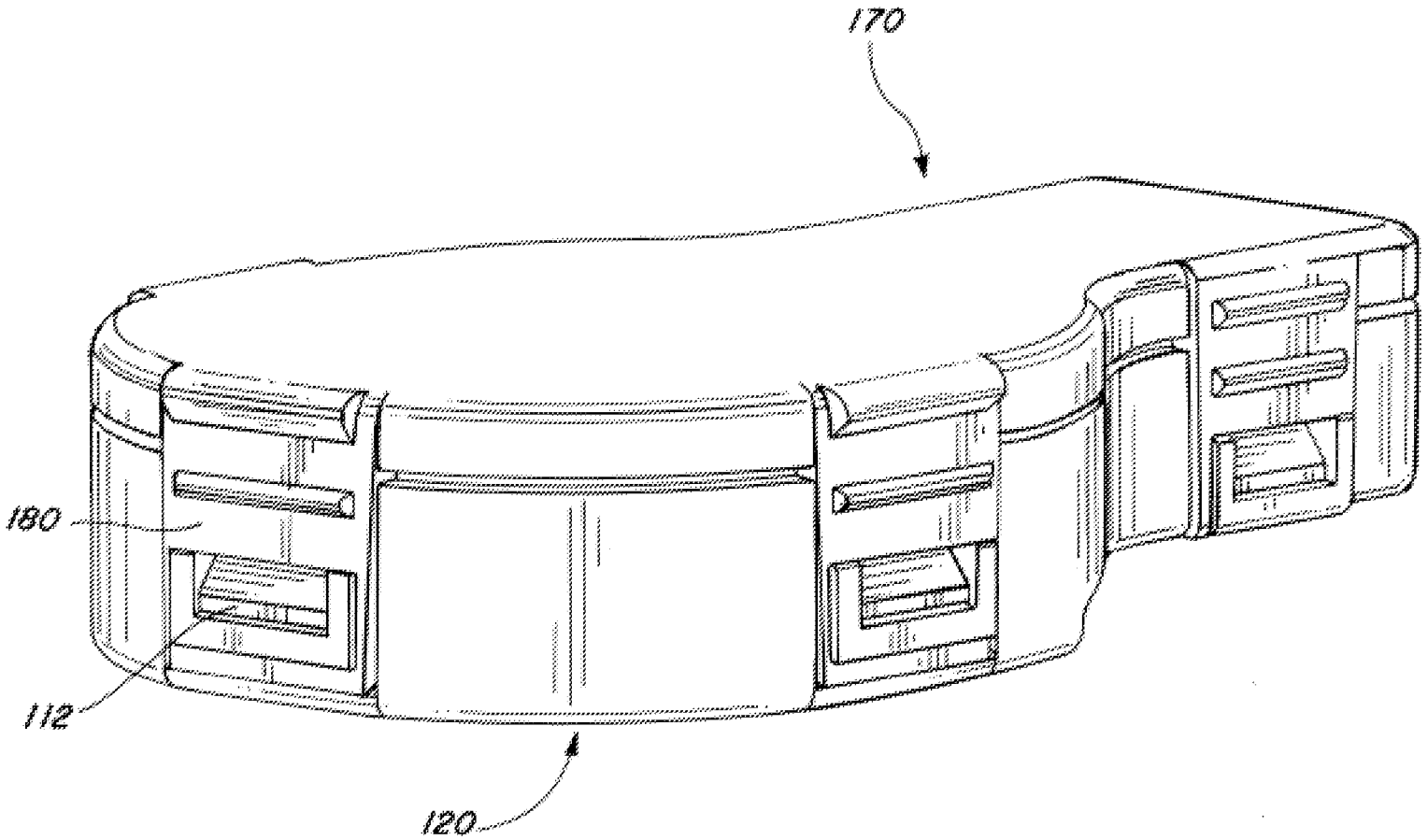
FIG. 8 is an assembled, perspective view of the second preferred embodiment of the flat electrical plug.

In an embodiment, the flat plug depicted in FIGS. 1-6 may be assembled using ultrasonic welding to weld the cap 70 to the housing 20. However, other fastening mechanisms are contemplated in embodiments. For example, FIG. 7 is an exploded, perspective view of a second preferred embodiment of the flat electrical plug. The housing 120 has one or more recessed sections on the housing outer surface 114. For example, housing 120 has a depressed, recessed section 110 along the housing outer surface 114. A protruding ridge 112 extends outward from the surface of the recessed section 110. The protruding ridge 112 preferably has an upper sloping contour and a bottom right-angle edge to facilitate assembly. The cap 170 has a protruding tab 180 extending in a direction parallel to the z-axis in this example. The protruding tab 180 has an aperture 182 having a shape and contour to receive the protruding ridge 112 during assembly. As depicted in FIG. 8, the cap 170 is secured to the housing 120 as a result of the aperture 182 of the protruding tab 180 engaging with the protruding ridge 112 of the housing 120.

FIG. 7 also depicts the cap 170 having an interior cap wall 184 and the housing 120 having an interior housing wall 116. During assembly, the wall 184 surrounds the housing wall 116 to seal the interior of the flat plug electrical connector from environmental contaminants.

Although the invention has been discussed with reference to specific embodiments, it is apparent and should be understood that the concept can be otherwise embodied to achieve the advantages discussed. The preferred embodiments above have been described primarily as low profile, flat plug electrical connectors having a strain relief section and an interlocking terminating end. Preferred embodiments rely on ultrasonic welding to weld the cap to the housing. Other embodiments rely on a tab mechanism to mechanically secure the cap to the housing. In this regard, the foregoing description of the flat plug electrical connector is presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An electrical plug comprising:

a housing comprising:

a front mating end having a at least two through-holes oriented in a first direction;

an integrated strain relief section extending from the front mating end in a second direction substantially perpendicular to the first direction;

at least two electrical contact members each placed in a corresponding through-hole;

an electrical cord having at least two electrical wires connected to the electrical contact members; and, a cap configured for mating with the housing and substantially enclosing the electrical cord and the electrical contact members, wherein:

the integrated strain relief section further comprises a plurality of internal ribs protruding inward from sides of the housing to the electrical cord, the plurality of internal ribs are configured for engaging the electrical cord, the plurality of internal ribs protruding inward and toward the front mating end forming an angle with respect to the normal of the sides of the housing.

2. An electrical plug comprising:

a housing comprising:

a front mating end having a first and second rectangular through-hole slots and a round through-hole oriented in a first direction;

an integrated strain relief section extending from the front mating end in a second direction substantially perpendicular to the first direction;

a housing terminating end extending from the strain relief section in the second direction, the housing terminating end further comprising a housing U-shaped member having arms extending outward parallel with a third direction perpendicular to the first and second directions;

an electrical cord having an outer sheath surrounding a hot wire, a neutral wire, and a ground wire;

a first pronged electrical contact member placed in the first rectangular through-hole slot and electrically coupled to the hot wire;

a second pronged electrical contact member placed in the second rectangular through-hole slot and electrically coupled to the neutral wire;

a male ground pin placed in the round through-hole and electrically coupled to the ground wire; and, a cap configured for mating with the housing and substantially enclosing the electrical cord and the electrical contact members, wherein the cap further comprises a cap front mating end, a cap strain relief section, and a cap terminating end configured for engaging the housing terminating end when the cap is assembled onto the housing, the cap terminating end having a cap U-shaped member and recesses extending outward parallel with the third direction, wherein the cap terminating end is configured for engaging the housing terminating end when the cap is assembled onto the housing.

3. An electrical plug comprising:

a housing comprising:

a front mating end having a first and second rectangular through-hole slots and a round through-hole oriented in a first direction;

an integrated strain relief section extending from the front mating end in a second direction substantially perpendicular to the first direction;

a housing terminating end extending from the strain relief section in the second direction;

an electrical cord having an outer sheath surrounding a hot wire, a neutral wire, and a ground wire;

a first pronged electrical contact member placed in the first rectangular through-hole slot and electrically coupled to the hot wire;

a second pronged electrical contact member placed in the second rectangular through-hole slot and electrically coupled to the neutral wire;

a male ground pin placed in the round through-hole and electrically coupled to the ground wire; and, a cap configured for mating with the housing and substantially enclosing the electrical cord and the electrical contact members, wherein the cap further comprises a cap front mating end, a cap strain relief section, and a cap terminating end configured for engaging the housing terminating end when the cap is assembled onto the housing, wherein the strain relief section comprises a plurality of internal ribs protruding inward and toward the front mating end forming an angle with respect to the normal of the sides of the housing, wherein the internal ribs are configured for engaging the electrical cord.

4. The electrical plug of claim 1, wherein the integrated strain relief section further comprises crimp members projecting in a direction opposite the first direction, wherein the crimp members are configured for engaging one of the at least two electrical wires.

5. The electrical plug of claim 1, wherein the cap further comprises at least one protruding ridge for engaging the electrical cord.

6. The electrical plug of claim 1, wherein the thickness of the assembled cap and housing is 11.8 millimeters or less.

7. An electrical plug comprising:

a housing comprising:

a front mating end having a at least two through-holes oriented in a first direction;

a housing terminating end extending from the front mating end in a second direction substantially perpendicular to the first direction, the housing terminating end further comprises a housing U-shaped member having arms extending outward parallel with a third direction perpendicular to the first and second directions;

at least two electrical contact members each placed in a corresponding through-hole;

an electrical cord having at least two electrical wires connected to the electrical contact members; and, a cap configured for mating with the housing and substantially enclosing the electrical cord and the electrical contact members, wherein the cap further comprises a cap front mating end and a cap terminating end configured for engaging the housing terminating end, the cap terminating end having a cap U-shaped member having recesses extending outward parallel with the third direction, wherein the cap terminating end is configured for engaging the housing terminating end when the cap is assembled onto the housing.

8. The electrical plug of claim 3, wherein the strain relief section further comprises crimp members projecting in a direction opposite the first direction, wherein the crimp members are configured for engaging the ground wire.

9. The electrical plug of claim 7, wherein:

the housing comprises an inner shoulder configured for receiving the cap such that an upper surface of the cap is flush with the housing.

10. The electrical plug of claim 7, wherein:

the front mating end further comprises a plurality of walls offset from and partially surrounding each of the through-holes to form mounting surfaces adjacent to the through-holes;

each of the electrical contact members further comprises:

a male connector placed in the through-hole;

a terminal for electrically connecting to the electrical wires; and, an electrical contact member tab perpendicular with the male connector configured for mounting on the mounting surface adjacent to the through holes; and, the cap further comprises at least two posts each configured for securing the electrical contact member tab against the mounting surface.

11. The electrical plug of claim 10, wherein each of the male connectors further comprises an electrical prong configured for receiving electricity from an electrical outlet.

12. The electrical plug of claim 7, wherein the cap is ultrasonically welded to the housing.

13. The electrical plug of claim 7, wherein:

the housing further comprises a recessed section on the outer surface of the housing, the recessed section having a protruding ridge extending outward from the recessed section;

the cap further comprises a protruding tab having an aperture; and, the cap is secured to the housing by the protruding tab engaging with the protruding ridge of the housing.

14. The electrical plug of claim 7, wherein the thickness of the assembled cap and housing is 11.8 millimeters or less.

15. An electrical plug comprising:

a housing comprising:

a front mating end having a first and second rectangular through-hole slots and a round through-hole oriented in a first direction, the front mating end further comprising a plurality of walls offset from and partially surrounding each of two rectangular through-hole slots and the round through-hole to form mounting surfaces adjacent to the two rectangular through-hole slots and the round through-hole;

an integrated strain relief section extending from the front mating end in a second direction substantially perpendicular to the first direction;

a housing terminating end extending from the strain relief section in the second direction;

an electrical cord having an outer sheath surrounding a hot wire, a neutral wire, and a ground wire;

a first pronged electrical contact member placed in the first rectangular through-hole slot and electrically coupled to the hot wire, the first pronged electrical contact member further comprising a first terminal for electrically connecting to the hot wire and a first tab perpendicular with the first pronged electrical contact member configured for mounting on the mounting surface adjacent to the first rectangular through-holes slot;

a second pronged electrical contact member placed in the second rectangular through-hole slot and electrically coupled to the neutral wire, the second pronged electrical contact member further comprising a second terminal for electrically connecting to the neutral wire, and a second tab perpendicular with the second pronged electrical contact member configured for mounting on the mounting surface adjacent to the second rectangular through-holes slot;

a male ground pin placed in the round through-hole and electrically coupled to the ground wire, the male ground pin further comprising a ground pin member tab perpendicular with the male ground pin configured for mounting on the mounting surface adjacent to the round through-hole; and, a cap configured for mating with the housing and substantially enclosing the electrical cord and the electrical contact members, wherein the cap further comprises a cap front mating end, a cap strain relief section, and a cap terminating end configured for engaging the housing terminating end when the cap is assembled onto the housing, the cap further comprising a first post for urging the first tab against the mounting surface adjacent to the first rectangular through-holes slot, a second post for urging the second tab against the mounting surface adjacent to the second rectangular through-holes slot, and a third post for urging the ground pin member tab against the mounting surface adjacent to the round through-hole.

16. The electrical plug of claim 15, wherein:

the housing terminating end further comprises a housing U-shaped member having arms extending outward parallel with a third direction perpendicular to the first and second directions;

the cap terminating end has a cap U-shaped member and recesses extending outward parallel with the third direction, wherein the cap terminating end is configured for engaging the housing terminating end when the cap is assembled onto the housing.

17. The electrical plug of claim 15, wherein the strain relief section comprises a plurality of internal ribs protruding inward and toward the front mating end forming an angle with respect to the normal of the sides of the housing, wherein the internal ribs are configured for engaging the electrical cord.

18. The electrical plug of claim 17, wherein the strain relief section further comprises crimp members projecting in a direction opposite the first direction, wherein the crimp members are configured for engaging the ground wire.

19. The electrical plug of claim 15, wherein the thickness of the assembled cap and housing is 11.8 millimeters or less.

20. The electrical plug of claim 15, wherein the cap is ultrasonically welded to the housing.

21. The electrical plug of claim 15, wherein:

the housing further comprises a recessed section on the outer surface of the housing, the recessed section having a protruding ridge extending outward from the surface of the side of the housing;

the cap further comprises a protruding tab having an aperture; and, the cap is secured to the housing by the protruding tab engaging with the protruding ridge of the housing.

* * * * *